US006553909B2

(12) United States Patent
Saito

(10) Patent No.: US 6,553,909 B2
(45) Date of Patent: Apr. 29, 2003

(54) APPARATUS FOR SEMI-AUTOMATING SWITCHING OPERATIONS OF WEB OFFSET PRINTING PRESS

(75) Inventor: Kazunori Saito, Higashikatsushika-gun (JP)

(73) Assignee: Komori Corporation, Tokyo (JP)

( * ) Notice: Subject to any disclaimer, the term of this patent is extended or adjusted under 35 U.S.C. 154(b) by 34 days.

(21) Appl. No.: 09/852,686

(22) Filed: May 11, 2001

(65) Prior Publication Data

US 2002/0002917 A1 Jan. 10, 2002

(30) Foreign Application Priority Data

May 17, 2000 (JP) ..... 2000-144891

(51) Int. Cl.[7] ..... B41F 17/06; B41F 5/00; B41F 1/46

(52) U.S. Cl. ..... 101/348; 101/213; 101/216

(58) Field of Search ..... 101/216, 219, 101/477, 479, 348, 212–215; 270/1.01, 20.1, 21.1

(56) References Cited

U.S. PATENT DOCUMENTS 3,771,446 A * 11/1973 KaneKo et al. ..... 101/144
5,699,735 A 12/1997 Stein et al. ..... 101/219
6,006,662 A * 12/1999 Ishida et al. ..... 101/141

FOREIGN PATENT DOCUMENTS

| | | |
|---|---|---|
| EP | 0533307 A1 | 3/1993 |
| EP | 0710558 A1 | 5/1996 |
| EP | 0983852 A1 | 3/2000 |

* cited by examiner

*Primary Examiner*—Huan Tran
*Assistant Examiner*—An H. Do
(74) *Attorney, Agent, or Firm*—Birch, Stewart, Kolasch & Birch, LLP

(57) ABSTRACT

An offset rotary printing press for semi-automating switch operations has a first switch for reducing an ink amount to a basic ink layer thickness distribution by an ink supplement device 800 and web rolls 101 and 102 are exchanged and succeeded by continuous supply device 100, a second switch for operating printing plate change device 207, 208 and folding device status switch in the folding device 700, and a third switch for activating ink supplement device 800 that overlaps an ink layer thickness distribution corresponding to the next printing.

10 Claims, 11 Drawing Sheets

APPARATUS FOR SEMI-AUTOMATING SWITCHING OPERATIONS OF WEB OFFSET PRINTING PRESS

The entire disclosure of Japanese Patent Application No. 2000-144891 filed on May 17, 2000 including specification, claims, drawings and summary is incorporated herein by reference in its entirety.

BACKGROUND OF THE INVENTION

1. Field of the Invention

The invention relates to an apparatus for semi-automating switching operations for a web offset printing press, and particularly to an apparatus for automatically actuating such devices successively by an operator pushing one or more buttons.

2. Description of Related Art

In a conventional art, when changing from a previous job to a next job in a web offset printing press, an operator has to operate each of the devices to operate the overall printing operation in a proper order. This takes a lot of time and is burdensome to the operator.

For example, when the previous job is finished, printing units are stopped to clean a blanket cylinder with a blanket. Then, the printing plates are exchanged, and further, an old web roll is changed to a new web roll. In order to prepare for the next job, various presetting operations, such as an adjustment of an open degree of an ink fountain key in accordance with a picture pattern of a new printing press, a control of a rotational amount of each ink fountain roll, a determination of an amount of dampening water to be su lied, and a setting of a folding machine In the above described conventional art, when changing from the previous job to the next job, an operator has to activate each device in order. Thus, it takes a long time and a heavy burden is imposed on the operator.

In the present invention, an operator merely pushes three buttons to automatically actuate each device in order to solve the above problems.

Further, it is also an object of the present invention to reduce the cost by changing a sheet travel path manually by an operator before operating a second switch, and visually checking by the operator that a printing plate is correctly changed and that a sufficient amount of a web roll is stocked before pushing a third button.

SUMMARY OF THE INVENTION

To accomplish the above object, an apparatus for automating switching operations of a web offset printing press according to the present invention comprises web continuous supplement means for attaching a web of a new web roll to a web of an old web roll to supply the web successively, printing plate changing means for changing a printing plate supported on a plate cylinder, folding device status switching means for switching a folding device status in accordance with a folding variation of the next printing, and ink supplement means for reducing ink amount to a basic ink layer thickness distribution and overlapping an ink layer distribution, corresponding to the next printing, on the basic ink layer thickness distribution, wherein the apparatus for automating switching operations of a web offset printing press is characterized by further comprising a switch for changing from a previous printing to the next printing. Based on a first signal from the switch, the ink supplement means reduces the ink amount to the basic ink layer thickness distribution, and the web continuous supplement means replaces and connects the web rolls. Based on a second signal from the switch, the printing plate changing means and the folding device status switching means are activated, and based on a third signal from the switch, the ink supplement means is activated to overlap the ink layer thickness distribution in accordance with the next printing.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
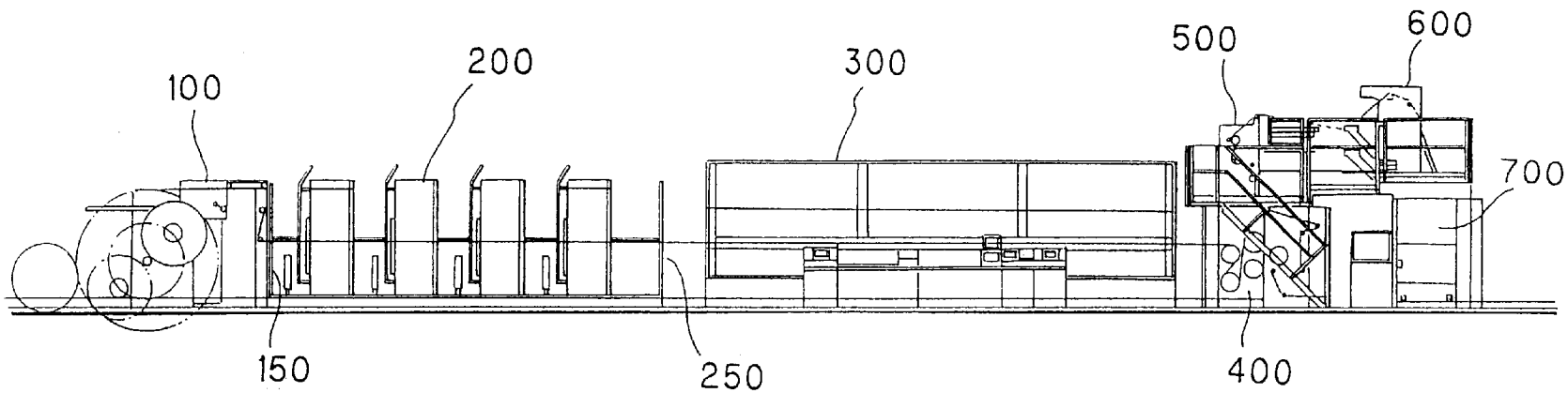
FIG. 1 is the entire schematic view of a offset rotary printing press of an embodiment according to the present invention.

A preferred embodiment of a web offset printing press according to the present invention is as shown in FIG. 1.

In the web offset printing press as shown in FIG. 1, a previous job can be automatically switched to a next job, by an operator pushing three buttons, thus, continuously activating each device. The web offset printing press comprises a sheet supply device 100, a plurality of printing units 200, a drying device 300, a cooling device 400, a web passing device 500, a drag device 600, a and so on.

Figure 2:
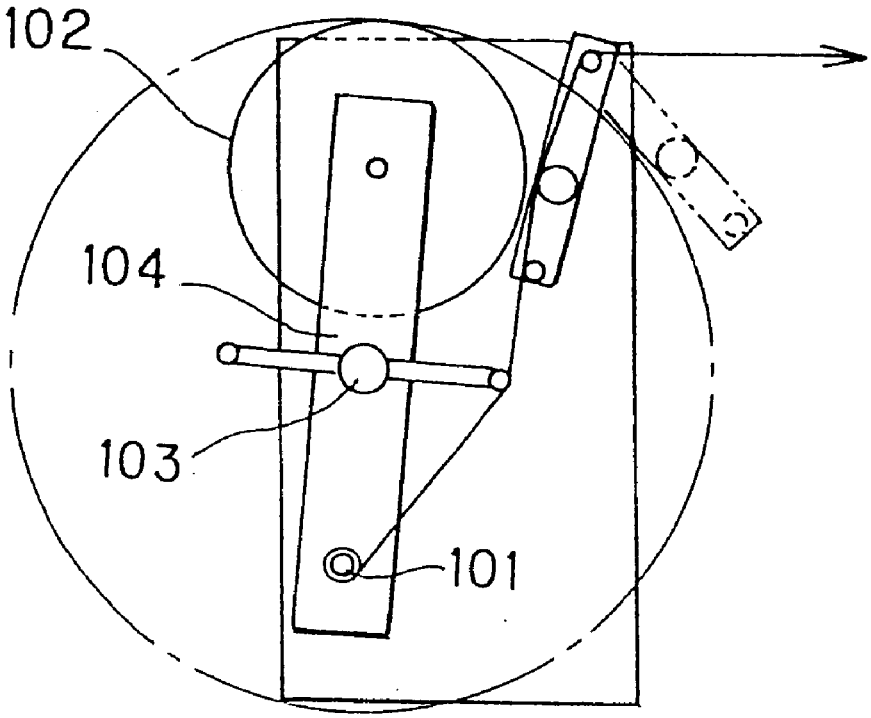
FIG. 2 shows a sheet supply device.

In the sheet supply device as shown in FIG. 2, two web rolls 101 and 102, each wound in a roll form, are attached to the opposite ends of a turret arm 104, respectively, and the turret arm 104 is pivotally mounted such that the arm 104 is rotatable about a central axis 103. When a web 10 (printing sheet) is rolled out from a web roll 101 and becomes close to the end thereof, a web from the next web roll 102 is connected and su lied to the printing units 200.

Figure 3:
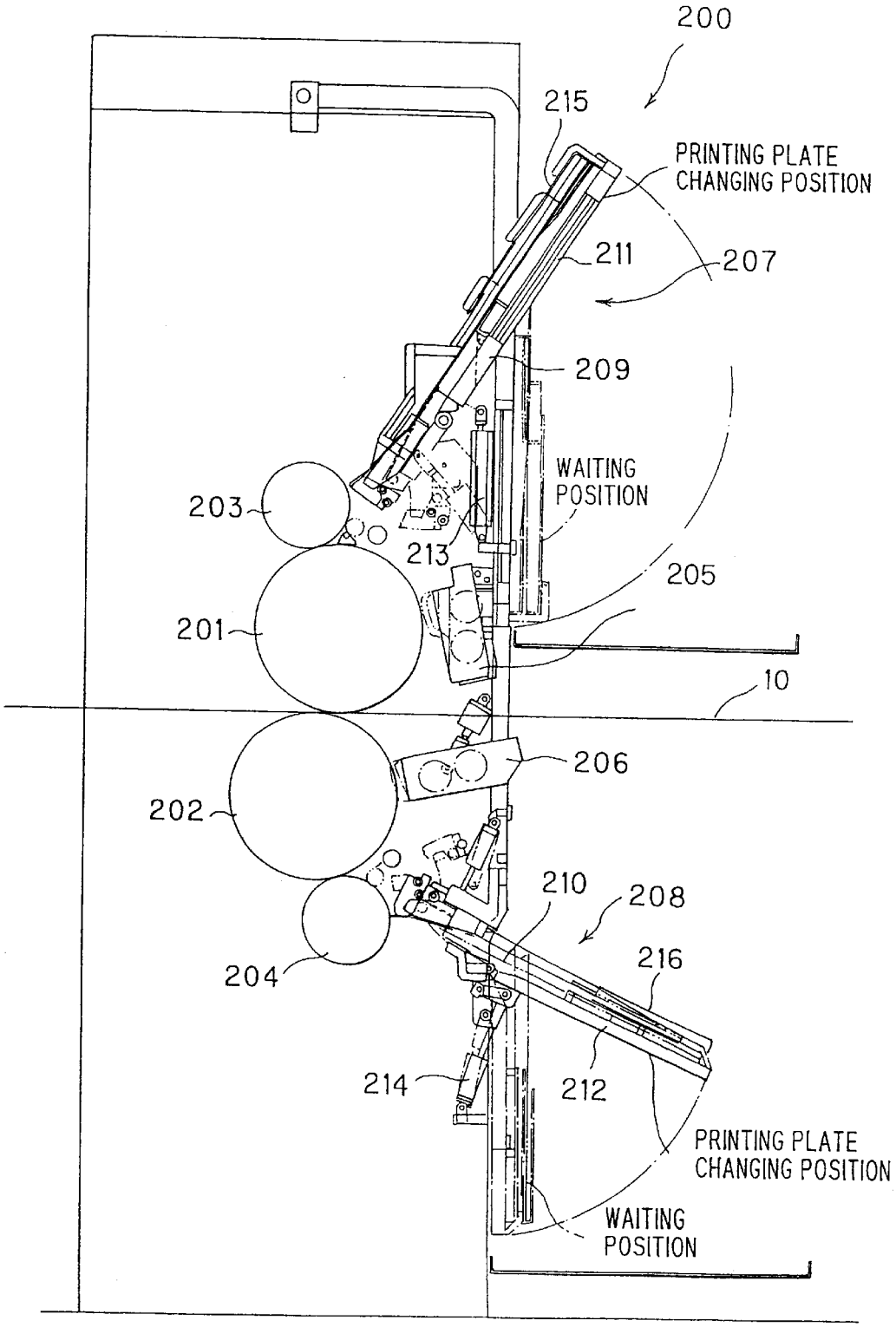
FIG. 3 is a cross sectional view of a printing unit.

In each printing unit 200 as shown in FIG. 3, blanket cylinders 201, 202 and printing cylinders 203, 204 are arranged symmetrically with respect to a horizontal web traveling path. A blanket cleaning device 205 (206) is provided at each blanket cylinder 201 (202) and an automatic printing plate changer (APC) 207 (208) is provided at the printing cylinder 203 (204).

The upper automatic printing plate changer 207 provides a guide frame 211 rotatable about a supporting axis 209, and an actuator 213 shifts the guide frame 211 from a stand by position to a printing plate changing position as shown in a dotted line. At the guide frame 211, a holder 215 for holding an old printing plate or a new printing plate is provided.

After shifting the guide frame 211 to the printing plate changing position, the old printing plate is disengaged from the printing cylinder 203. By backwardly rotating the printing plate 203, the old printing plate is guided along the guide frame 211 so that the old printing plate can be picked up by extending/shrinking an actuator (not shown). Then, the new printing plate is supplied to the printing cylinder 203 along the guide frame 211. By forwardly rotating the printing plate 203, the new printing plate is attached to the printing cylinder 203.

Similarly, a lower automatic printing plate changing device 208 provided a guide frame 212 rotatable about a supporting axis 210, and an actuator 214 shifts the guide frame 212 from a stand by position to a printing plate changing position along a dotted line as shown in the drawing. A holder 216 for holding the old printing plate or the new printing plate is provided at the guide frame 212.

After shifting the guide frame 212 to the printing plate changing position, the old printing plate is disengaged from the printing cylinder 204. By backwardly rotating the printing cylinder 204, the old printing plate is lowered along the guide frame 211.

Then, the new printing plate is supplied to the printing cylinder 204 along the guide frame 212. By forwardly rotating the printing cylinder 204, the new printing plate is attached to the printing cylinder 204.

Figure 4:
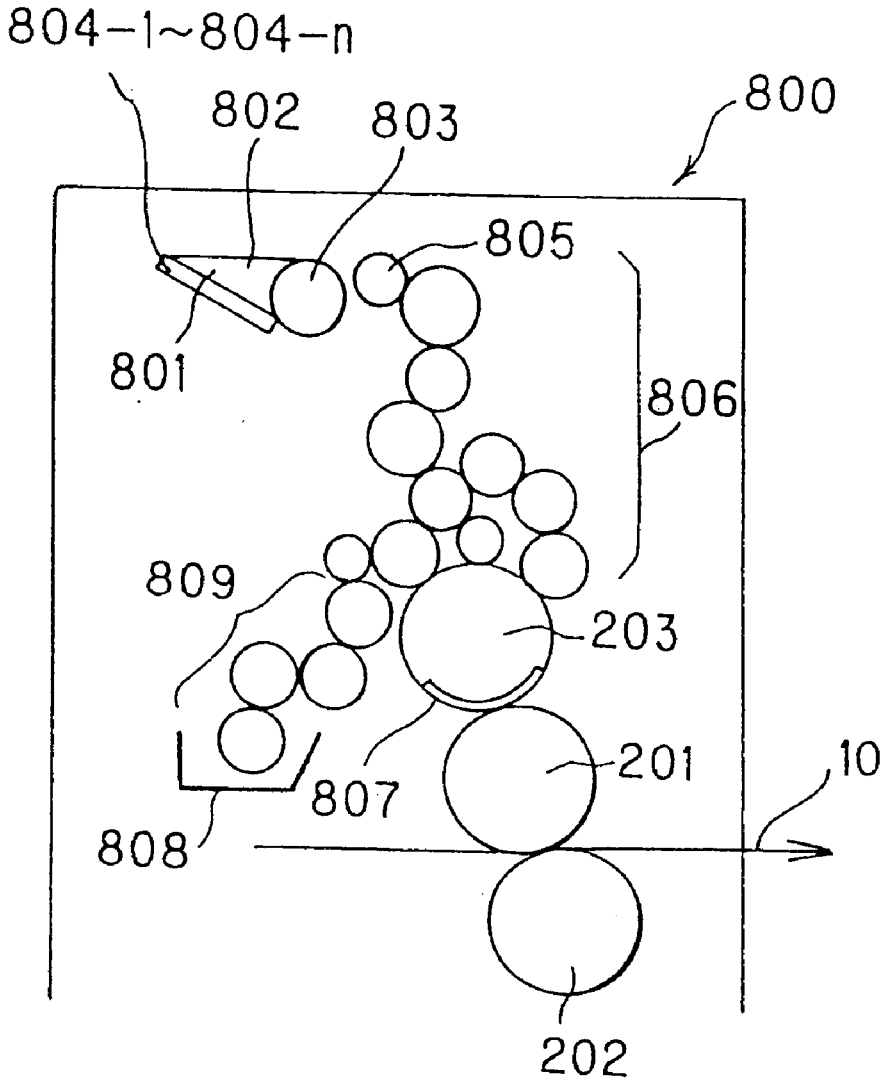
FIG. 4 shows an ink supply device.

Regarding the printing plate mounted on the printing cylinder 203 (204), an ink supplement device 800 is provided as shown in FIG. 4.

The ink supply device 800 supplies ink 802 in an ink fountain 801 onto an ink fountain roller 803 by adjusting the degree of openness of each of the ink fountain keys 804–1, 801–2, . . . 801–n. Ink supplied on the ink fountain roller 803 is transferred to a printing plate 807 through a group 806 of ink rollers by operating an ink ductor roller 805. Simultaneously with such an ink supply operation, dampening water 808 is supplied to the printing plate 807 through a group of dampening rollers 809.

The ink supply device 800, when changing the old printing plate 807 to a new printing plate, printing data such as the degree of openness of the each ink fountain keys 804–1, 804–2, 804–n corresponding to the picture pattern of the new printing plate, a rotational amount of the ink fountain roller 803, and a supply amount of dampening water 808 is preset as described below.

The blanket cleaning device 205 (206) removes foreign matter such as any remaining ink and so on b contacting a brush or cloth with the blanket cylinder 201 (202). A drying machine 300 is a device for heating and drying a printed web 10 fed through the printing units 200. A cooling device 400 is a device for cooling the web 10 passed through the drying machine 300. A web path device 500 is a device for adjusting a passing direction to control a position of a web and its tensile force. A folding device 700 is a device for cutting the web after drying and cooling operations and folds each piece of the web 10.

There are a number of types of folding devices based on combinations of cutting and folding the web, such as folding along a central line of the web with respect to a width direction, it is a so-called "former fold", cutting a web having a predetermined length by a cut-off cylinder, folding a cut-off sheet by a folding cylinder along a width direction or a longitudinal direction, it is a so-called "parallel fold", and half folding parallel folded sheets by a chopper along an orthogonal direction.

An infeed dancer device 150 is provided between the sheet supply device 100 and the printing units 200, and a final unit dancer device 250 is provided between the printing units 200 and the drying machine 300.

The dancer device 150 (250) winds a web among three rollers, and by moving a central roller in a vertical direction, removes slackness in the web caused by rotation of the printing units 200 in forward/backward directions.

These devices 200 through 700 are connected by a driving axis and are driven by a main motor (not shown) mounted at the printing units 200. The main motor can be disconnected from the driving axis by operating a driving clutch provided between the printing units 200 and the final unit dancer 250.

Figure 5:
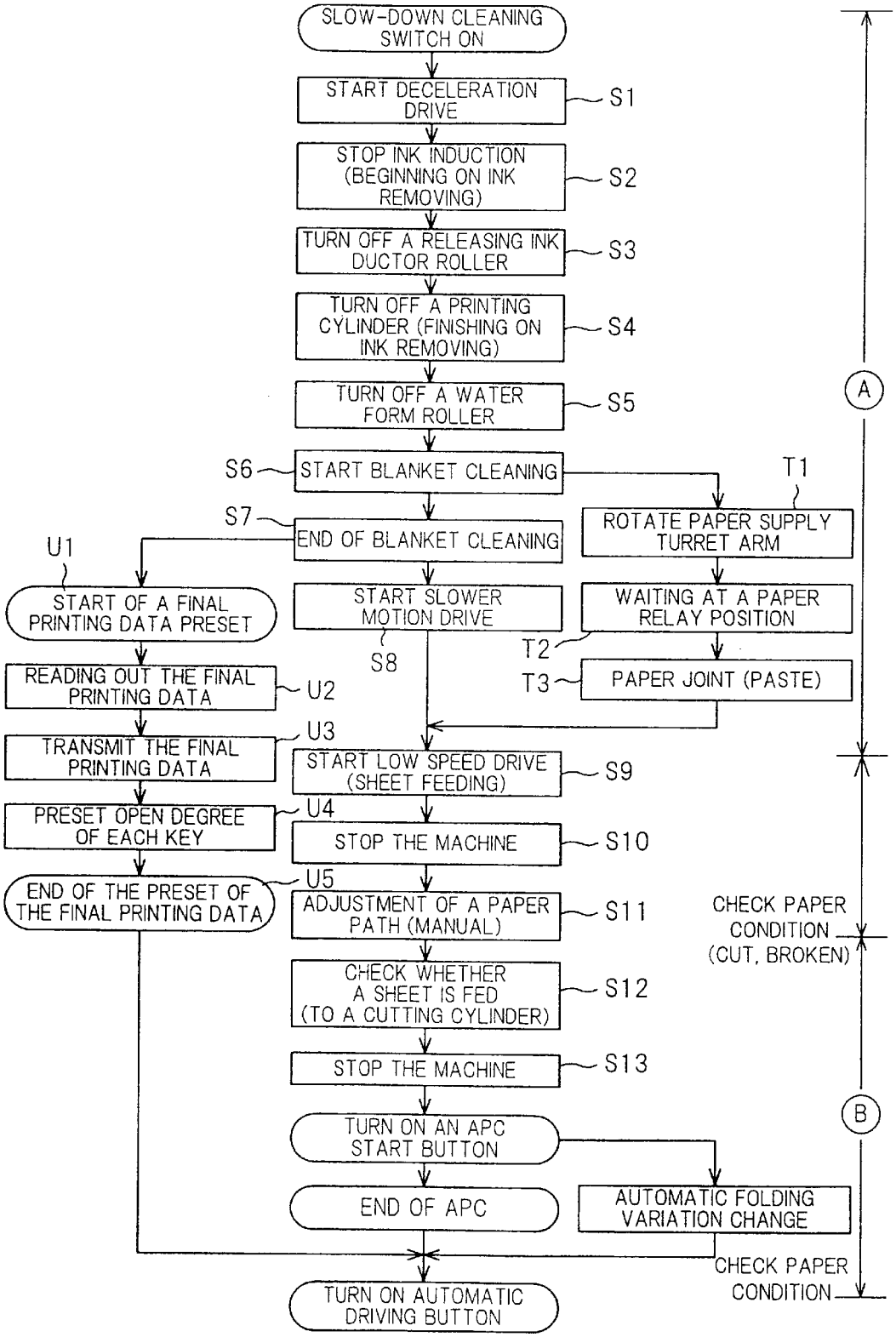
FIG. 5 is a flow-chart showing a plurality of steps A executed by pushing on a deceleration cleaning switch.
Figure 6:
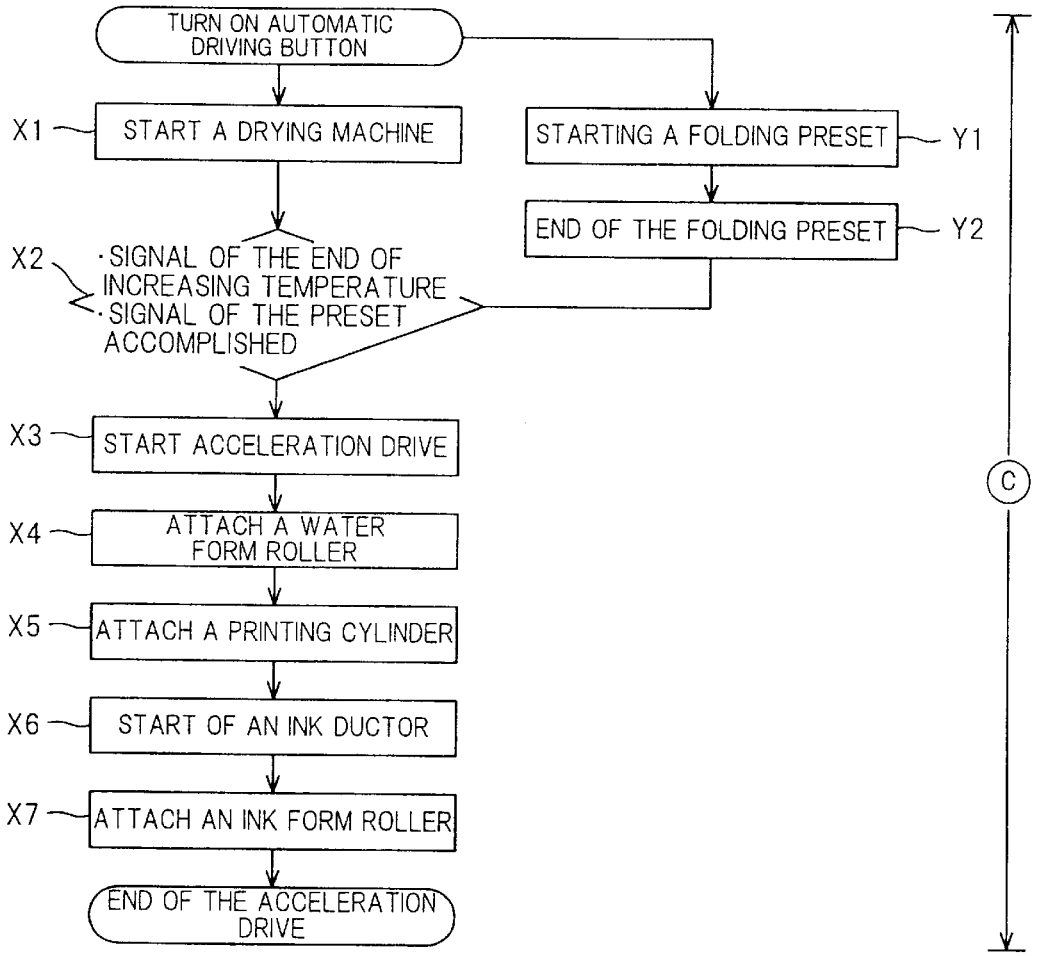
FIG. 6 is another flow-chart showing a plurality of steps C executed by pushing on the automatic drive start switch.
Figure 9:
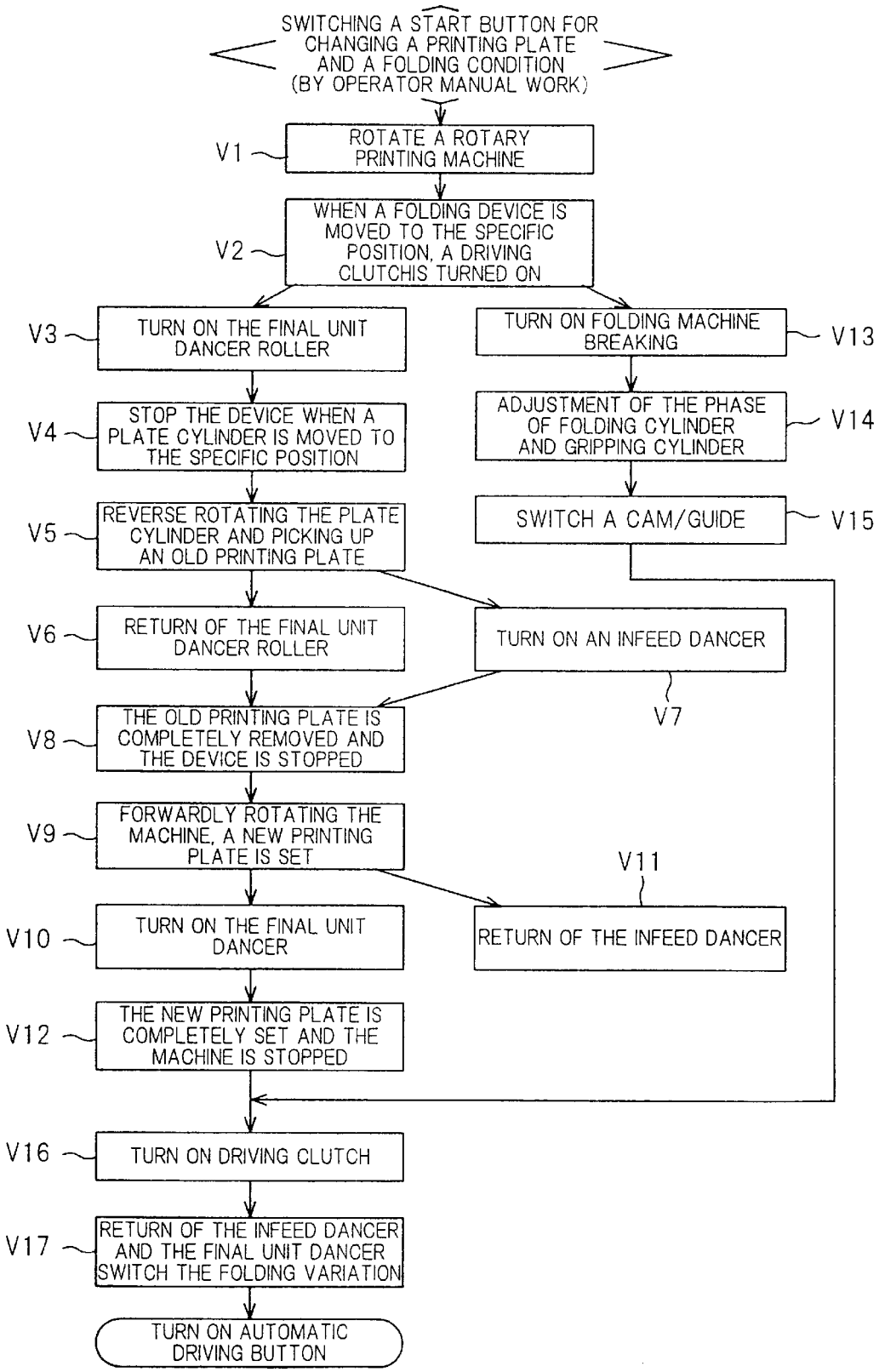
FIG. 9 is another flow-chart showing a plurality of steps B executed by pushing on the switch for APC and the selection of the folding device status.

In the offset rotary printing press constructed as described above a semi-automatic device that executes, upon changing a printing job, an adjustment of an ink layer thickness, an exchange of web rolls, an exchange of printing plates, and a selection of a folding method, as shown in flow charts illustrated in FIGS. 5, 6, and 9, is provided. A web speed is, while the semi-automatic device is being actuated, shown in FIG. 7.

(1) A Reduced-Speed Cleaning Switch is Turned On.

By turning on a reduced-speed cleaning switch, a plurality of steps A are continuously and simultaneously executed automatically as shown in FIG. 5.

Figure 7:
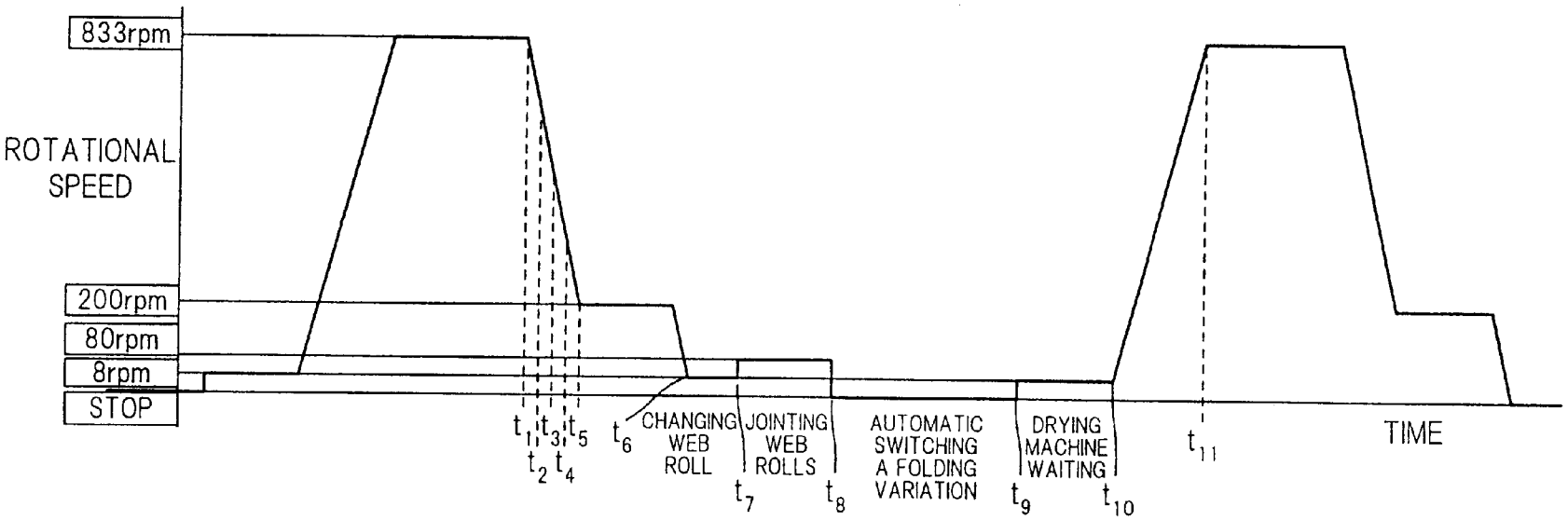
FIG. 7 is a time-chart for indicating a feeding speed of the web.

When the previous job is finished, an operator turns on the reduced-speed cleaning switch, to switch the job, at a time t1, as shown in FIG. 7, to start a slowing down of the web (step S1).

When the rotational speed of the printing cylinders 203 (204) becomes S1 at a time t2 as shown in FIG. 7, the ink ductor roller 805 is stopped to shut-down the ink supply to the group of ink rollers 806 (step S2).

While continuing the printing operation in a decelerating mode, ink removal is conducted, ink on the group of ink rollers 806 is consumed, and gradually reduces the thickness of the ink layer.

When the rotational speed of the printing cylinders 203 (204) becomes S2 at a time t3, an ink form roller is released (step S3). Simultaneously, rotation of the blanket cylinder 201 (202), as a printing cylinder, and plate cylinders 203 (204) are turned off(S4). The ink removal, is started at the time t2 finishes at a time t3.

Figure 8:
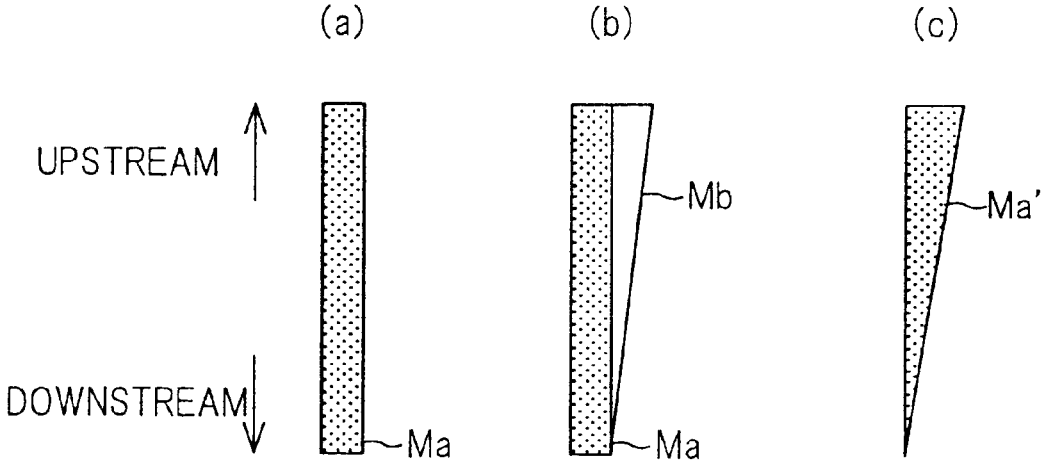
FIG. 8 shows an ink layer thickness.

As shown in FIG. 8, in the ink removal operation, an ink layer thickness distribution Mb corresponding to a printed pattern of the old printing plate, which is formed on the group of ink rollers 806, is removed at the time t2. At the time t3, a minimum ink layer thickness distribution Ma' required for actual printing that becomes thinner along a direction from an upstream to a downstream remains.

In FIG. 8, Ma indicates the minimum ink layer thickness required during printing and Mb indicates a condition in which a new ink layer is overlapped on the minimum ink layer Ma.

Then, at a time 14 as shown in FIG. 7, a water form roller in the group of ink rollers 809 is released (step S5).

An ink layer thickness distribution on the group of the ink rollers 806 becomes flat by the rotation of the group of the rollers 806 at the time t3. Thus, the ink layer thickness distribution becomes the minimum ink layer thickness distribution Ma, required for printing, as shown in FIG. 8(*a*).

As a result, the ink layer thickness distribution on the group of the ink rollers 806 becomes the minimum ink layer thickness distribution Ma. Therefore, a new printing job is not influenced by the picture pattern of the previous printing job. As described below, when a print pattern of the next printing job is preset, an ink layer thickness distribution can be quickly changed to a distribution corresponding to the printing pattern of the next job.

When the rotational speed of the web is decelerated to 200 rpm, the blanket cylinder 201 (202) is cleaned by a blanket cleaning device 205 (206) at a time t5 as shown in FIG. 7 (step S6).

After finishing the blanket cleaning (step S7), the web begins a slower motion driving at a speed of about 8 rpm at a time t6 as shown in FIG. 7 (step S8).

On the other hand, at the same time as initiation of the blanket cleaning, the turret arm 104 of the sheet supply device 100 is rotated (step T1). Then, the new web roll 102 is placed at a predetermined relay position (step T2). Further, after starting the above slower motion drive, a sheet relay of the old web roll 101 to the new web roll 102 is executed (step T3).

Thus, while the blanket cleaning is being accomplished in the printing units 200, the sheet relay is executed in the sheet supply device 100 so that the total operation time can be shortened.

After finishing the sheet relay, a reduced-speed rotation of the web at about 200 rpm is started at a time t7 as shown in FIG. 7 (step S9).

Since the reduced-speed rotation is faster than the above slower motion drive, a portion of the web joining an old sheet and a new sheet can be quickly fed through and discharged from the folding device 700.

Then, the apparatus (only printing units 200) is stopped at a time t8 as shown in FIG. 7 (step S10).

An operator manually changes a traveling path of a sheet, a so-called "sheet path," in the drag device 600 and the folding device 700 (step S11). After adjusting the sheet path, the sheet is fed to confirm that the sheet passes through a cutting cylinder of the folding device 700 (step S 12), and the apparatus is stopped (step S13).

After stopping the apparatus, the operator checks the condition of the paper, such as by cutting and tearing a broken portion and a cut position. Between the blanket cleaning (step S7) and the reduced-speed rotation (step S9), data for final printing is simultaneously preset (step U1).

The data for final printing such as the degree of openness of the each ink fountain keys 804–1, . . . 804–n, the rotational amount of an ink fountain roller 803, and the amount of dampening water 808 supplied is read out from a data base of a computer (not shown) (step U2). The read out data for the final printing is transmitted to the ink supply device 800 (step U3) to preset the data for final printing including the degree of openness of the each ink fountain key in a control device of the ink supply device 800 (step U4).

The presetting of the data for final printing must be conducted for each of the upper and lower ink supply devices 800. In the case of a multi-color double-sided printing, the presetting is necessary eight times because the preset must be conducted for each color.

As described above, while a hardware treatment with respect to each device 100 through 700 is conducted, a software treatment such as the presetting of the final printing data is simultaneously conducted to shorten the total operation time.

As long as the presetting of the final printing data is started after finishing the blanket cleaning (step S7) and finished before accomplishing the automatic printing plate change as described below, it need not be finished before the device stops (step S13).

(2) Printing Plate Folding Device Status Change Switch is Turned on.

When an operator turns on a switch for changing a printing plate and folding device status, a plurality of steps B as shown in FIG. 5 are continuously and simultaneously executed automatically.

The plurality of steps B, as shown in FIG. 9, automatically execute the change of the printing plates and a switch in selection of the folding device status simultaneously.

Namely, when the printing plate and folding device status change switch is turned on, the rotary printing press is activated (step V1) and the driving clutch is turned off when the folding cylinder of the folding machine has moved to a specific position (step V2).

The reason for turning of the driving clutch is to avoid the occurrence of troubles caused by the reverse rotation of the folding machine 700.

As described below, if a web is fed in a reverse direction in order to automatically exchange printing plates in the printing units 200, a folded sheet falls from a jaw cylinder and a folding cylinder in the folding device 700 for cutting and folding.

Next, the final unit dancer is turned on (step V3) so that a web fed from the printing units 200 to the drying device 300 is prevented from becoming loose by winding the web around a roller moving in a up-down direction.

The plate cylinders 203 (204) are rotated in the reverse direction, the old printing plate is removed from the plate cylinder 203 (204) by the automatic printing plate exchanger 207(208) (step V5).

The plate cylinders 203 (204) is rotated in the reverse direction, the old printing plate is removed from the plate cylinder 203 (204) by the automatic printing plate exchanger 207 (208) (step V5).

By rotating the plate cylinder 203 (204) in a reverse direction, a roller of the final unit dancer 250 is returned to the original position (step V6). At the same time, the infeed dancer device 150 is turned on (step V7) in order to prevent the web fed from the printing units 200 to the sheet supply device 100 from loosening.

Thereafter, after finishing removal of the old printing plate, the machine (the printing units 200 only) is stopped (step V8).

Then, the machine (the printing units 200 only) is rotated in the forward direction, the new printing plate is supplied from the automatic printing plate exchanger 207 (208) and attached to the plate cylinder 203 (203) (step V9).

Further, the final unit dancer 250 is turned on (step V10) to prevent the web fed from the printing units 200 to the drying machine 300 from becoming loose. Simultaneously, the roller of the infeed dancer device 150 is returned to the original position (step V11).

When setting of the new printing plate on the plate cylinder 203 (204) has been completed, the machine (the printing units 200 only) is stopped (step V12).

After turning off the driving clutch, a brake in the folding machine is turned on (step Vi 3) to change the folding device status simultaneously.

The folding device status is changed by adjusting a phase of the folding cylinder and the gripping cylinder (step V14), and a selection of a cam/guide member (step V15).

An adjustment of the phase of the folding cylinder and the gripping cylinder means to change the phase of a gripping board of the gripping cylinder with respect to a needle and a knife of the folding cylinder corresponding to a single parallel fold or a double parallel fold. For example, as shown in Japanese Patent Publication Kokai 63-282053, the adjustment is made by a gear transmission mechanism.

Switching of the cam/guide member includes cam switching for changing a phase of a cam mechanism for switching an operation timing of a gripping claw, knife, needle and so on provided at a cutting cylinder, a folding cylinder and a gripping cylinder and a guide switching mechanism for changing the single parallel fold, the double parallel fold, and a delta fold.

Figure 10:
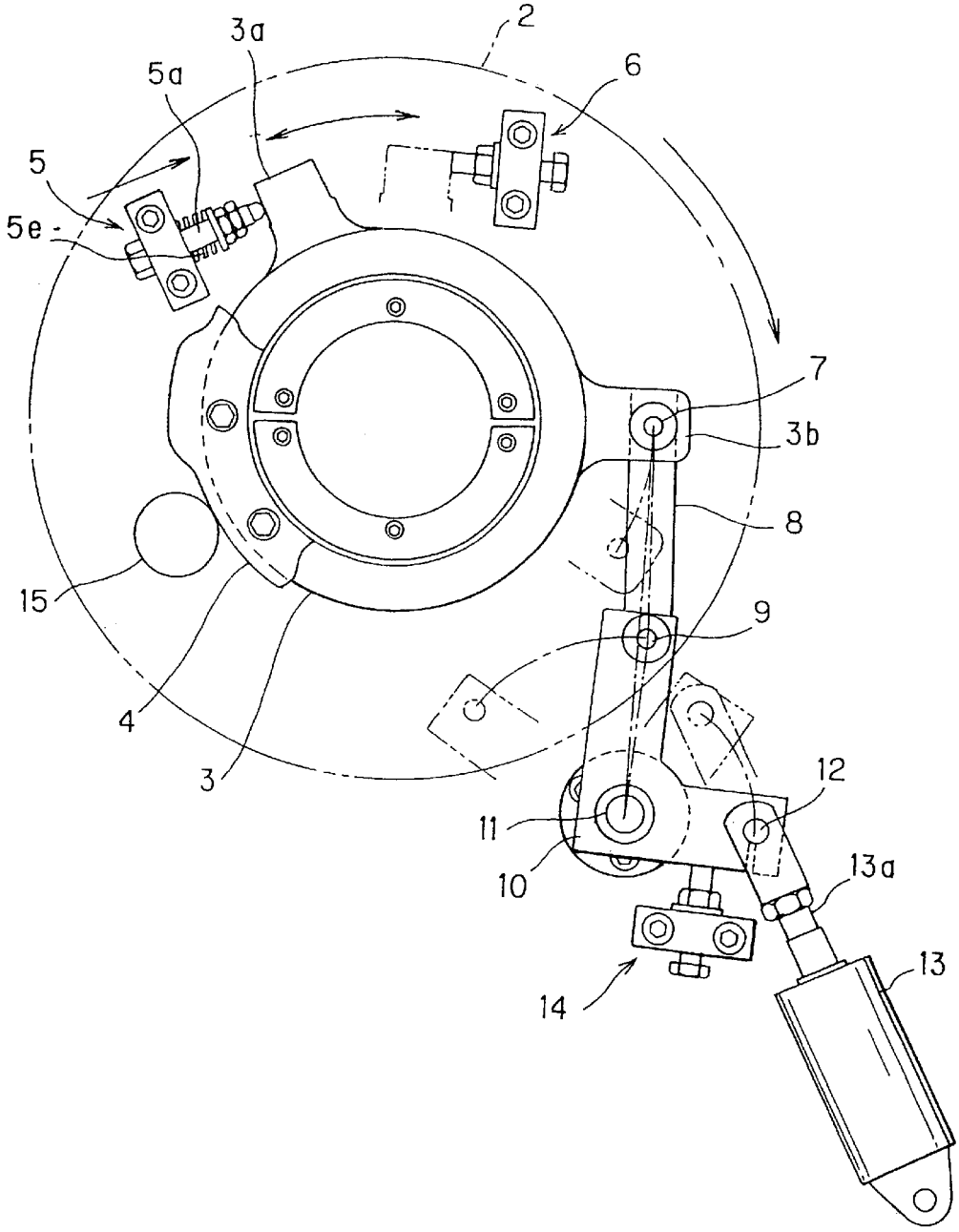
FIG. 10 shows a cam switching operation.

As shown in FIG. 10, a cam switching mechanism comprises a cam holder 3 rotatably supported and having, on an outer peripheral portion thereof, protrusions 3*a*, 3*b*, a circular cam 4 attached to the cam holder 3 and having a predetermined outer peripheral shape, a cam follower 15 that rolls on the outer peripheral surface of the cam 4, a link plate 8 connected to the protrusion 3*b* of the cam holder 3 which extends and retreats to rotate the cam holder 3, a lever 10, an air cylinder 13, a first stopper 6 for restricting rotation of the cam 4 in one rotating direction caused by the extension of the air cylinder 13, a second stopper 14 for restricting rotation of the cam 4 in the opposite rotating direction caused by retraction of the air cylinder 13, and a third stopper 5 for urging the protrusion 3*a* of the cam holder 3, restricted from rotating in the opposite direction by the second stopper 14, in the one rotating direction restricted by the second stopper 14 (Japanese Patent Application Hei 10-301983.

Figure 11:
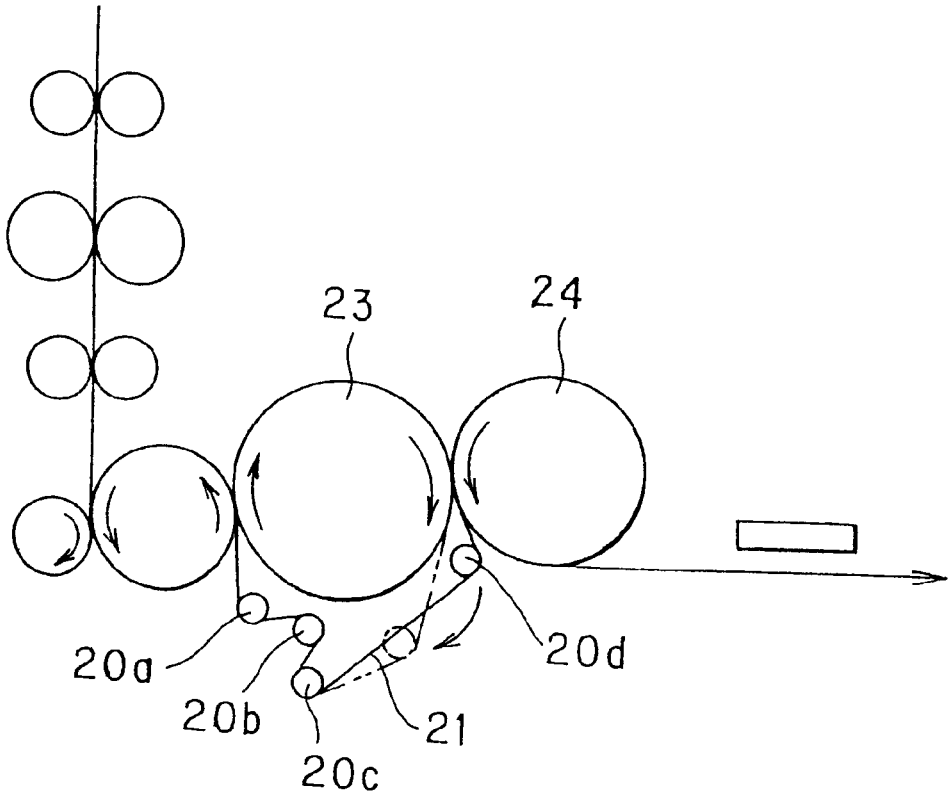
FIG. 11 shows a guide switching operation.

As the guide switching member, there is an embodiment as shown in FIG. 11 (Japanese Patent Application No.10-266166).

The device, shown in FIG. 11, is a parallel folding device having a first gripping cylinder 23 and a second gripping cylinder 24, the peripheral surfaces of which are in contact with each other. A belt 21 is wound on the first gripping cylinder 23 and rollers 20*a* through 20*d* are arranged parallel to the first gripping cylinder 23.

In the case where a single parallel fold is accomplished in the device, the roller 20*d* is moved along a solid line in FIG. 11 and the belt 21 is moved to a guiding position.

At the guiding position of the belt 21, a sheet is changed from the first gripping cylinder 23 to the second gripping cylinder 24 to parallel-fold the sheet once.

If double parallel fold or delta folding is required, the roller 20*d* is moved toward an arrow along a dotted line in FIG. 11 and the belt 21 is shifted to a shelter position.

At the shelter position of the belt 21, the double parallel fold or the delta folding is accomplished when the sheet is passed from the first gripping cylinder 23 to the second gripping cylinder 24.

Upon finishing the above exchange of the printing plates and the selection of folding device status, the driving clutch is turned on (step V16), and the dancer devices 150, 250 are returned to their original positions (step V17).

Thus, the automatic printing plate change and the switch of the folding device status are accomplished.

(3) Automation Driving Start Switch is Turned On.

As described above upon accomplishing the automatic change of the printing plates, a switch of the folding device status, and a presetting of the final printing data, an operator checks the condition of the web. By turning on the automatic driving start switch, a plurality of steps C, as shown in FIG. 6, are automatically executed continuously and simultaneously to prepare for the next printing job.

At a time t9 as shown in FIG. 7, the machine is rotated at a slower-speed of about 8 rpm. A stand by operation of the drying machine 300 is started (step X1). Simultaneously, a folding preset is started (step Y1). The folding preset means adjusts the position of each control axis of the folding machine 700 in accordance with the next job, and includes positioning of former, chopper based on width, quality, and thickness of a sheet.

In the above described embodiment, although it is explained that the folding preset is accomplished simultaneously with a stand by driving of the drying device 300, the folding preset may be accomplished simultaneously with the changing of the paper path.

Further, when a completion signal of increasing the temperature of the drying machine 700 and a completion signal of presetting the folding machine are input (step X2), the feeding speed of the web is increased (step X3).

After the rotational speed is accelerated to a predetermined speed, the water supply roller 809 is attached to supply the dampening water 808 (step X4), the blanket cylinders 201 (202) as a printing plate cylinder and the plate cylinder 203 (204) are attached (step X5), and dampening operation of the ink ductor roller 805 is started to operate pre-inking (step X6). the pre-inking, the degree of openness of the each ink fountain key 804–1, . . . 804–n corresponding to a picture pattern of a new printing picture, the rotational amount of the ink fountain roller 803, and the supplied amount of the dampening water 808 are adjusted in accordance with the final printing data preset in the ink supply device 800 with respect to the new job. Regarding the minimum ink layer thickness Ma, remaining at the group of ink rollers 806, required to print (FIG. 8(*a*)), the ink layer thickness distribution Mb corresponding to the picture pattern of the new printing plate is overlapped (FIG. 8(*b*)).

After finishing the pre-inking, the group of ink rollers 806 are engaged (step X7). When the printing speed is accelerated to the predetermined speed, the acceleration of the rotational speed is finished.

As described above, in the embodiment according to the present invention, when the previous job is switched to the next job, each of the devices 100 through 800 are automatically operated by an operator's pushing of three buttons so that the total operation time can be shortened and the o erator's task/burden becomes lighter.

That is, by actuating the first switch for deceleration cleaning, ink removal, blanket cleaning, exchanging/paper-connecting of web rolls, and a final printing data preset can be operated. Further, the blanket cleaning, the exchanging/paper-connecting of web rolls, and the final printing data preset are operated simultaneously so that the total operation time can be shortened. By turning on the second switch for automatically changing printing plates and the folding device status, the automatic change of printing plates and a selection of the automatic folding device status can be made. In addition, the automatic exchange of printing plates and the selection of the automatic folding device status are accomplished in parallel so that the total operation time can be shortened.

Particularly, after turning on the first deceleration cleaning switch to accomplish the ink removal, the blanket cleaning, and the preset for the final printing data, and before turning on the second switch for changing printing plates and selecting the folding device status, an operator can manually change the travel path of a sheet in the folding device 700. After completion of the automatic change of the printing plates and the folding device status by the operation of the second switch for changing printing plates and the folding device status and before turning on a third switch for starting an automatic drive, the operator can visually check whether a printing plate is completely changed without errors and troubles and a new web roll is sufficiently stocked so that the operation cost can be remarkably saved.

As described above with respect to the embodiment, in the semi-automated switching apparatus for the offset printing press according to the present invention, when switching from a previous job to a next job, an operator only has to operate three switches in order to automatically activate each device in order. Therefore, the total operation time can be shortened and the operator's task can be reduced.

After completing a plurality of operations actuated by the first switch, an operator can manually change a sheet travel path in a folding machine before turning on the second switch. After completing a plurality of operations actuated by the second switch, the operator can visually check whether a printing plate is correctly changed and whether the condition of the web is normal. Thus, the operational cost can be reduced.

The present invention is, of course, in no way restricted to the specific disclosure of the specification and drawings, but also encompasses any modifications within the scope of the appended claims.

What is claimed is:

1. An apparatus for semi-automating switching operations of a web offset printing press, comprising:

web continuous supplement means for connecting a web of a new web roll with a web of an old web roll to supply the web successively;

printing plate change means for changing a printing plate supported on a plate cylinder;

folding device status switching means for switching a folding device status of a folding machine in accordance with a folding variation of a next printing;

ink supplement means for reducing ink amount to a basic ink layer thickness distribution and overlapping an ink layer distribution corresponding to the next printing on the basic ink layer thickness distribution; and at least one switch for changing a previous printing to the next printing, wherein the ink amount is reduced to the basic ink layer thickness distribution by said ink supplement means and each position of said new and old web rolls are changed and said web of said new web roll is connected with said web of said old web roll by said web continuous supplement means in accordance with a first signal from said switch, said printing plate change means and said folding device status switching means in said folding machine are operated in accordance with a second signal from said switch, and said ink supplement means for overlapping an ink layer thickness distribution corresponding to said next printing is operated in accordance with a third signal from said switch.

2. An apparatus for semi-automating switching operations of a web offset printing press as claimed in claim 1, wherein at least two of (1) said web continuous supplement means, (2) said printing plate change means, (3) said folding device switching means, and (4) said ink supplement means are operable in parallel.

3. An apparatus for semi-automating switching operations of a web offset printing press as claimed in claim 2, wherein said printing plate change means and said folding device switching means are operable in parallel.

4. A process in an apparatus for semi-automating switch operations of a web offset printing press including:

web continuous supplement means for connecting a web of a new web roll with a web of an old web roll to supply the web successively, printing plate change means for changing a printing plate supported on a plate cylinder, folding device status switching means for switching a folding device status of a folding machine in accordance with a folding variation of a next printing, and ink supplement means for reducing ink amount to a basic ink layer thickness distribution and overlapping an ink layer distribution corresponding to the next printing on the basic ink layer thickness distribution, and at least one switch for changing a previous printing to the next printing, said process comprising the steps of:

reducing an ink amount to the basic ink layer thickness distribution by said ink supplement means and changing a position of said web rolls and connecting said webs of said web rolls by said web continuous supplement means in accordance with a first signal from said switch;

operating said printing plate change means and said folding device status switching means in said folding device in accordance with a second signal from said switch; and operating said ink supplement means for overlapping an ink layer thickness distribution corresponding to said next printing in accordance with a third signal from said switch.

5. The process according to claim 4, further comprising the step of;

cleaning a blanket cylinder by blanket cleaning means; and connecting said web of a new web roll with said web of said old web roll to supply said web successively, wherein said cleaning step and said connecting steps are operated simultaneously after finishing said reducing step.

6. The process according to claim 5, further comprising the steps of;

reading out data from a data base for overlapping said ink layer distribution corresponding to the next printing on said basic ink layer thickness distribution by said ink supplement means in order to preset said data as the next printing data, while said blanket cylinder is being cleaned by said blanket cleaning means.

7. A process in an apparatus for semi-automating switching operations of a web offset printing press as claimed in claim 4, said apparatus further comprising a plurality of sheet paths in said folding device, said process further comprising the steps of:

shifting a sheet feeding path to another sheet feeding path in said folding device before said second signal from said switch;

detecting whether a changing of printing plates has been accomplished correctly; and checking a condition of said web while at least one of said printing plate change means and said folding device status switching means is being operated and before the third signal from said signal.

8. A process in an apparatus for semi-automating switching operations of a web offset printing press as claimed in claim 7, wherein said shifting of said sheet feeding path to another sheet feeding path in said folding device before said second signal from said switch is accomplished manually, and said detecting of the changing of said printing plates is accomplished visually.

9. A process in an apparatus for semi-automating switching operations of a web offset printing press as claimed in claim 4, wherein at least two of (1) said connection of a web to a new web roll by said web continuous supplement means, (2) said changing of a printing plate on a plate cylinder by said printing plate change means, (3) said switching of a folding device's status by said folding device switching means, and (4) said reduction of said ink amount and overlapping of said ink layer's distribution by said ink supplement means are accomplished in parallel.

10. A process in an apparatus for semi-automating switching operations of a web offset printing press as claimed in claim 9, wherein said changing of a printing plate on a plate cylinder by said printing plate change means and said switching of a folding device's status by said folding device switching means are accomplished in parallel.

* * * * *